US009704675B2

(12) United States Patent
Liu et al.

(10) Patent No.: US 9,704,675 B2
(45) Date of Patent: Jul. 11, 2017

(54) CONTACT MODULE FOR CIRCUIT BREAKER

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Yi Liu, Shanghai (CN); Xiang Gu, Shanghai (CN); Zhongbin Wang, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 0 days.

(21) Appl. No.: 15/024,334

(22) PCT Filed: Sep. 19, 2014

(86) PCT No.: PCT/CN2014/086918
§ 371 (c)(1),
(2) Date: Mar. 23, 2016

(87) PCT Pub. No.: WO2015/043422
PCT Pub. Date: Apr. 2, 2015

(65) Prior Publication Data

US 2016/0233038 A1 Aug. 11, 2016

(30) Foreign Application Priority Data

Sep. 24, 2013 (CN) ..... 2013 1 0438970

(51) Int. Cl.
*H01H 33/02* (2006.01)
*H01H 33/42* (2006.01)
(Continued)

(52) U.S. Cl.
CPC ..... *H01H 33/022* (2013.01); *H01H 1/2058* (2013.01); *H01H 33/42* (2013.01);
(Continued)

(58) Field of Classification Search
CPC .... H01H 1/2058; H01H 33/022; H01H 33/42; H01H 33/53; H01H 33/60; H01H 9/563;
(Continued)

(56) References Cited

U.S. PATENT DOCUMENTS 5,281,776 A * 1/1994 Morel ..... H01H 1/2058 218/152
6,259,338 B1 * 7/2001 Boeder ..... H01H 1/2041 335/6

(Continued)

FOREIGN PATENT DOCUMENTS

CN 2572543 Y 9/2003
CN 101320659 A 12/2008

(Continued)

OTHER PUBLICATIONS

Official Action issued Feb. 2, 2016, by the State Intellectual Property Office of the People's Republic of China, in related Chinese Patent Application No. CN 201310438970.5, with English translation of the Search Report contained herein (6 pages).

(Continued)

*Primary Examiner* — Renee Luebke
*Assistant Examiner* — William Bolton
(74) *Attorney, Agent, or Firm* — Osha Liang LLP

(57) ABSTRACT

A contact module for a circuit breaker is disclosed, comprising: a base, a cover, an operation mechanism, at least three kinds of asymmetrical single-pole switches and a release mechanism. The cover is mounted on the base to form a space, where the mechanisms and the switches are disposed. The operation mechanism is connected to one (Continued)

switch; the release mechanism to the at least three switches. Each switch comprises a strong side and a weak side. For each switch, there is a thick contact housing on the strong side connected to a thick shaft, and a thin one on the weak side connected to a thin shaft. A rotor component has a single contact spring mounted on the weak side. Rotation shafts are connected by a linkage shaft to connect the single-pole switches; a strong side of one switch is connected to a weak side of another switch.

7 Claims, 13 Drawing Sheets

(51) Int. Cl.

| | |
|---|---|
| ***H01H 33/53*** | (2006.01) |
| ***H01H 33/60*** | (2006.01) |
| ***H01H 1/20*** | (2006.01) |
| ***H01H 71/02*** | (2006.01) |
| ***H01H 71/10*** | (2006.01) |
| ***H01H 73/04*** | (2006.01) |

(52) U.S. Cl.
CPC ..... *H01H 33/53* (2013.01); *H01H 33/60* (2013.01); *H01H 71/0257* (2013.01); *H01H 71/1009* (2013.01); *H01H 73/045* (2013.01); *H01H 1/205* (2013.01); *H01H 71/1027* (2013.01); *H01H 2071/1036* (2013.01); *H01H 2235/01* (2013.01)

(58) Field of Classification Search
CPC ..... H01H 71/02; H01H 71/0257; H01H 71/1045; H01H 71/1009; H01H 73/045; H01H 2235/01; H01H 1/205; H01H 71/1027; H01H 2071/1036
USPC ..... 218/152, 155, 154, 156; 335/156, 201, 335/202
See application file for complete search history.

(56) References Cited

U.S. PATENT DOCUMENTS

| | | | | |
|---|---|---|---|---|
| 6,480,082 | B1 | 11/2002 | Aihara et al. | |
| 8,071,898 | B2 * | 12/2011 | Bennett | H01H 1/205 200/244 |
| 8,207,459 | B2 * | 6/2012 | Bae | H01H 71/1009 200/50.32 |
| 2004/0227598 | A1 | 11/2004 | Ciarcia et al. | |
| 2006/0152308 | A1 * | 7/2006 | Rajauria | H01H 1/205 335/16 |
| 2007/0075047 | A1 * | 4/2007 | Oh | H01H 71/1009 218/154 |
| 2012/0152718 | A1 | 6/2012 | Grumel et al. | |
| 2012/0199452 | A1 | 8/2012 | Dahl et al. | |

FOREIGN PATENT DOCUMENTS

| | | | |
|---|---|---|---|
| CN | 102412103 | A | 4/2012 |
| CN | 103094015 | A | 5/2013 |
| EP | 0560696 | A1 | 9/1993 |
| JP | 2003-086071 | A | 3/2003 |

OTHER PUBLICATIONS

International Search Report issued in PCT/CN2014/086918 mailed on Dec. 17, 2014 (2 pages).
Written Opinion of the International Searching Authority issued in PCT/CN2014/086918 mailed on Dec. 17, 2014 (4 pages).
Extended European Search Report issued in corresponding European Application No. 14847398.6 dated Mar. 17, 2017 (6 pages).

* cited by examiner

CONTACT MODULE FOR CIRCUIT BREAKER

BACKGROUND OF THE INVENTION

1. Field of the Invention

The present invention relates to circuit breakers, more particularly, relates to a contact module for circuit breaker with an asymmetric structure.

2. The Related Art

It is well known that a circuit breaker with dual breakpoint has a current breaking capacity which is much higher than a circuit breaker with single breakpoint. The circuit breaker with dual breakpoint utilizes modularized structure which results in convenient assembly and good insulation ability. However, dual breakpoint structure requires that each level of the circuit breaker comprise two contact modules. The contact modules shall have high strength since the circuit breaker will bear large breaking current and the contact modules will bear strong gas shock waves. A high strength requires that a housing of the contact module shall have sufficient thickness, so a phase spacing of the circuit break cannot be reduced. For circuit breakers with large current breaking capacities such as 100 A, 125 A or 160 A, a width dimension of the circuit breakers will be very large. However, miniaturization is a demand and trend for circuit breakers. It is obvious that there is a contradiction between the current breaking capacity and the dimension of a circuit breaker.

For example, an existing four-level circuit breaker with a current breaking capacity of 160 A has a width dimension of 120 mm and a spacing of 30 mm. Though the circuit breaker may bear a large current, the dimension of the circuit breaker is too large and will obviously constrain the application and installation of the circuit breaker.

SUMMARY

The present invention discloses a contact module for circuit breaker considering both a current breaking capacity and a dimension of the contact module. By using an asymmetric structure and a single contact spring, the dimension of the contact module is reduced while maintaining the current breaking capacity.

According to an embodiment of the present invention, a contact module for circuit breaker is disclosed. The contact module comprises: a base, a cover, an operation mechanism, three kinds of single-pole switches and a release mechanism. The cover is mounted on the base to form an accommodation space, the operation mechanism, the three kinds of single-pole switches and the release mechanism are disposed in the accommodation space. The operation mechanism is connected to one kind of the single-pole switch, the release mechanism is connected to the three kinds of the single-pole switches. All of the three kinds of single-pole switches are asymmetrical. Each kind of single-pole switch comprises a strong side and a weak side, for each kind of single-pole switch, a contact housing on the strong side is thick and is connected to a thick shaft, a contact housing on the weak side is thin and is connected to a thin shaft. A rotor component in each kind of single-pole switch only has a single contact spring and the single contact spring is mounted on the weak side. Rotation shafts of adjacent single-pole switches are connected by a linkage shaft so that the single-pole switches are connected, a strong side of one single-pole switch is connected to a weak side of another single-pole switch.

In an embodiment, each kind of single-pole switch comprises a contact housing module assembled by two contact housings, a rotor component disposed in the contact housing module, two rotation shafts connecting the rotor component and the two contact housings. The assembled two contact housings form an internal chamber in which the rotor component is mounted, the contact housing on the strong side forms thick side walls of the internal chamber and the contact housing on the weak side forms thin side walls of the internal chamber. The thick shaft cooperates with the thick side walls of the internal chamber formed by the contact housing on the strong side, and a strong side lug is provided. The thin shaft cooperates with the thin side walls of the internal chamber formed by the contact housing on the weak side, and a weak side lug is provided.

In an embodiment, the strong side lug is step-shaped, the weak side lug is inclined.

In an embodiment, the three kinds of single-pole switch comprises a first single-pole switch, a second single-pole switch and a third single-pole switch. Two first single-pole switches act as N phase and A phase of the contact module. The operation mechanism is connected to the second single-pole switch, the second single-pole switch acts as B phase of the contact module. The third single-pole switch acts as C phase of the contact module.

In an embodiment, the first single-pole switch comprises a first contact housing, a second contact housing, a first rotation shaft, a second rotation shaft, a first rotor component, a static contact and an arc extinguishing chamber. The first contact housing is a strong side contact housing and the second contact housing is a weak side contact housing, the first contact housing and the second contact housing are assembled to form an internal chamber, which accommodates the first rotor component, the static contact and the arc extinguishing chamber. The first rotation shaft is a thick rotation shaft and cooperates with the first contact housing, the second rotation shaft is a thin shaft and cooperates with the second contact housing, the first rotation shaft does not extend outside the first contact housing, the second rotation shaft extends outside the second contact housing.

In an embodiment, the second single-pole switch comprises a third contact housing, a fourth contact housing, a first rotation shaft, a third rotation shaft, a second rotor component, a static contact and an arc extinguishing chamber. The third contact housing is a weak side contact housing and has a symmetric structure with respect to the second contact housing, the fourth contact housing is a strong side contact housing and has a symmetric structure with respect to the first contact housing, the third contact housing and the fourth contact housing are assembled to form an internal chamber, which accommodates the second rotor component, the static contact and the arc extinguishing chamber, the second rotor component has a symmetric structure with respect to the first rotor component. The first rotation shaft cooperates with the fourth contact housing, the third rotation shaft is a thin shaft and cooperates with the third contact housing, the third rotation shaft does not extend outside the third contact housing, and the first rotation shaft does not extend outside the fourth contact housing.

In an embodiment, the third single-pole switch comprises a third contact housing, a fourth contact housing, a first rotation shaft, a second rotation shaft, a second rotor component, a static contact and an arc extinguishing chamber. The third contact housing is a weak side contact housing and has a symmetric structure with respect to the second contact housing, the fourth contact housing is a strong side contact housing and has a symmetric structure with respect to the first contact housing, the third contact housing and the fourth contact housing are assembled to form an internal chamber, which accommodates the second rotor component, the static contact and the arc extinguishing chamber, the second rotor component has a symmetric structure with respect to the first rotor component. The first rotation shaft cooperates with the fourth contact housing, the second rotation shaft cooperates with the third contact housing, the first rotation shaft does not extend outside the fourth contact housing, the second rotation shaft extends outside the third contact housing.

The present invention utilizes an asymmetric structure. For a single-pole switch, the thickness of side walls on one side of the housing is reduced and only a single contact spring is used in a rotor component. A dimension of a contact module is reduced while maintaining the strength of the contact module and a current breaking capacity of the circuit breaker.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

The present invention utilizes an asymmetric contact module, where a rotor component in the contact module only includes a single contact spring. Side walls on different sides of the contact module have different thicknesses. A thickness of a single-pole switch is reduced while maintaining the strength of the contact module at a desired level. An overall width dimension of a circuit breaker including connected contact modules may be reduced.

Figure 1:
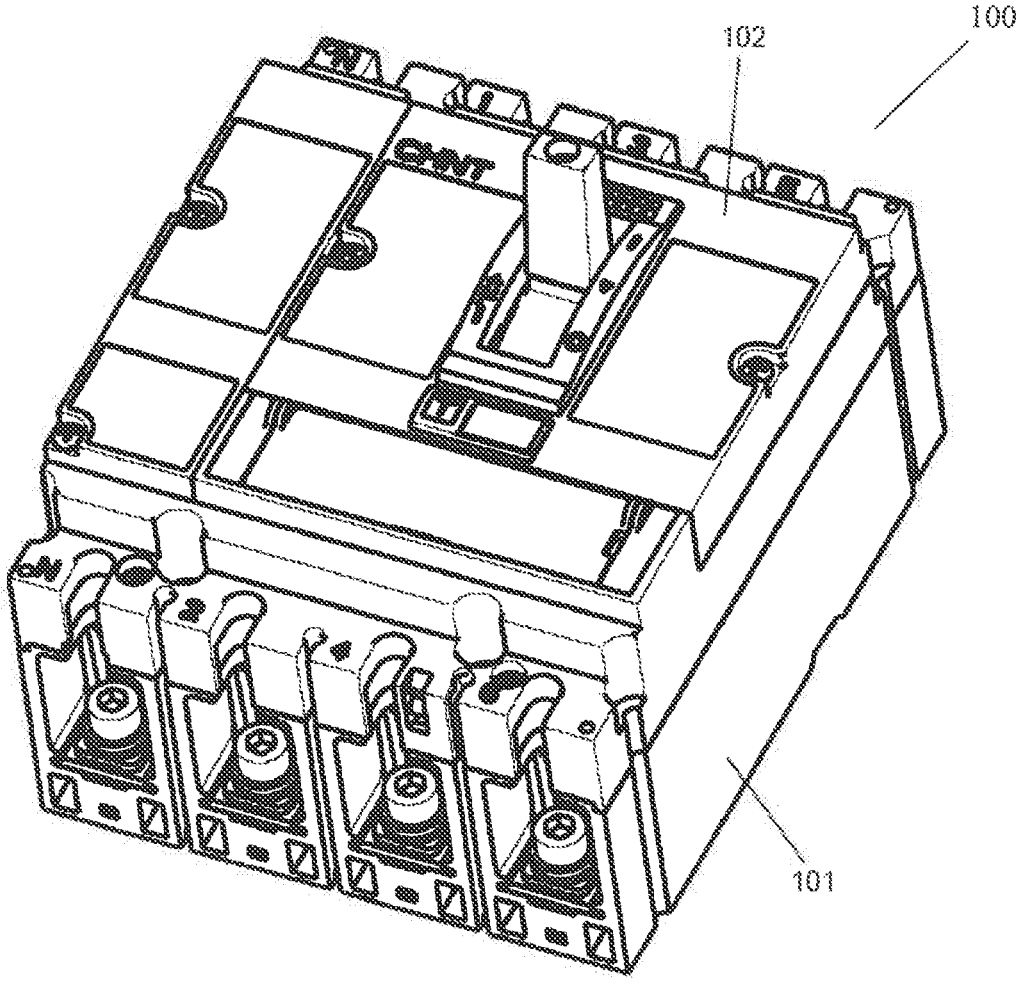
FIG. 1 illustrates the structure of a circuit breaker according to an embodiment of the present invention.
Figure 2:
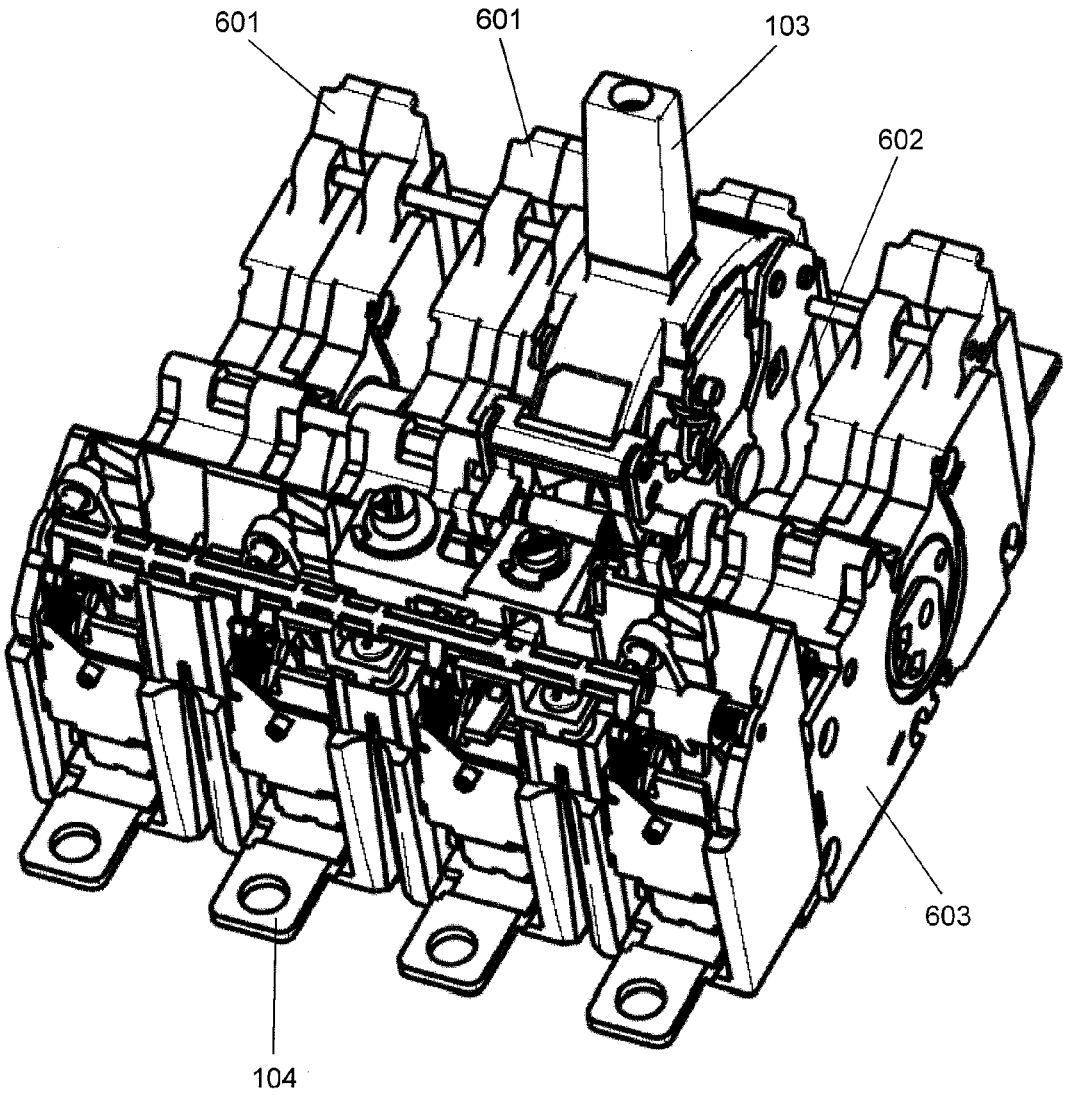
FIG. 2 illustrates the structure of a circuit breaker without a base and a cover.

As shown in FIG. 1 and FIG. 2, the present invention discloses a contact module 100 for circuit breaker. The contact module 100 comprises: a base 101, a cover 102, an operation mechanism 103, three kinds of single-pole switches and a release mechanism 104. FIG. 1 illustrates the structure of a circuit breaker. FIG. 2 illustrates the structure of a circuit breaker without a base and a cover.

The cover 102 is mounted on the base 101 to form an accommodation space. The operation mechanism 103, the three kinds of single-pole switches and the release mechanism 104 are disposed in the accommodation space. The operation mechanism 103 is connected to one kind of the single-pole switch. The release mechanism 104 is connected to all the three kinds of the single-pole switches. All of the three kinds of single-pole switches are asymmetrical, each kind of single-pole switch comprises a strong side and a weak side. For each kind of single-pole switch, a contact housing on the strong side is thick and is connected to a thick shaft, while a contact housing on the weak side is thin and is connected to a thin shaft. A rotor component in each kind of single-pole switch only has a single contact spring and the single contact spring is mounted on the weak side. Rotation shafts of adjacent single-pole switches are connected by a linkage shaft so that the single-pole switches are connected. A strong side of one single-pole switch is connected to a weak side of another single-pole switch.

Each kind of single-pole switch comprises a contact housing module assembled by two contact housings, a rotor component disposed in the contact housing module, and two rotation shafts connecting the rotor component and the two contact housings. The assembled two contact housings form an internal chamber in which the rotor component is mounted. The contact housing on the strong side forms thick side walls of the internal chamber and the contact housing on the weak side forms thin side walls of the internal chamber. The thick shaft cooperates with the thick side walls of the internal chamber formed by the contact housing on the strong side, and a strong side lug is provided. The thin shaft cooperates with the thin side walls of the internal chamber formed by the contact housing on the weak side, and a weak side lug is provided.

According to the present invention, four kinds of contact housings are provided, including a first contact housing 201, a second contact housing 202, a third contact housing 203 and a fourth contact housing 204. The first contact housing 201 and the second contact housing 202 are matched and assembled, while the third contact housing 203 and the fourth contact housing 204 are matched and assembled. The first contact housing 201 and the fourth contact housing 204 have relatively symmetric structures, the first contact housing 201 and the fourth contact housing 204 are strong side contact housings and have thick side walls. The second contact housing 202 and the third contact housing 203 have relatively symmetric structures, the second contact housing 202 and the third contact housing 203 are weak side contact housings and have thin side walls. In an assembled contact housing module, an internal chamber is not positioned in the middle, but will deviate to the weak side.

Figure 6:
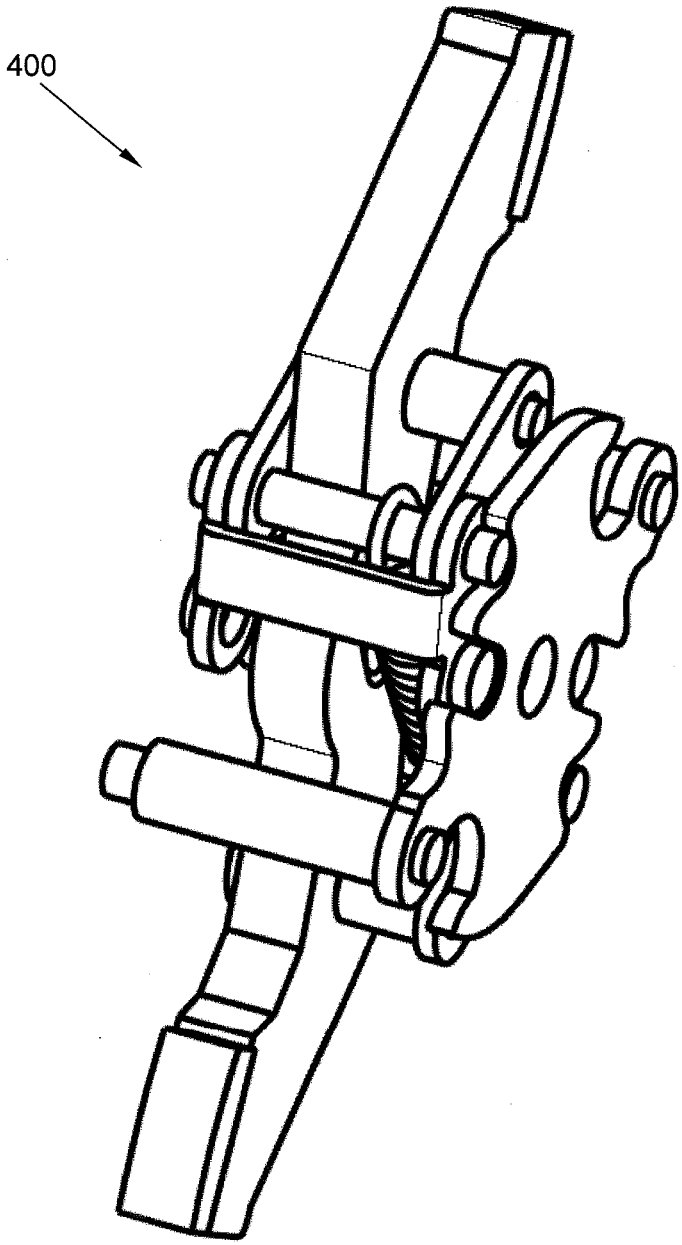
FIG. 6 illustrates the structure of a first rotor component in a contact module for circuit breaker according to an embodiment of the present invention.
Figure 7:
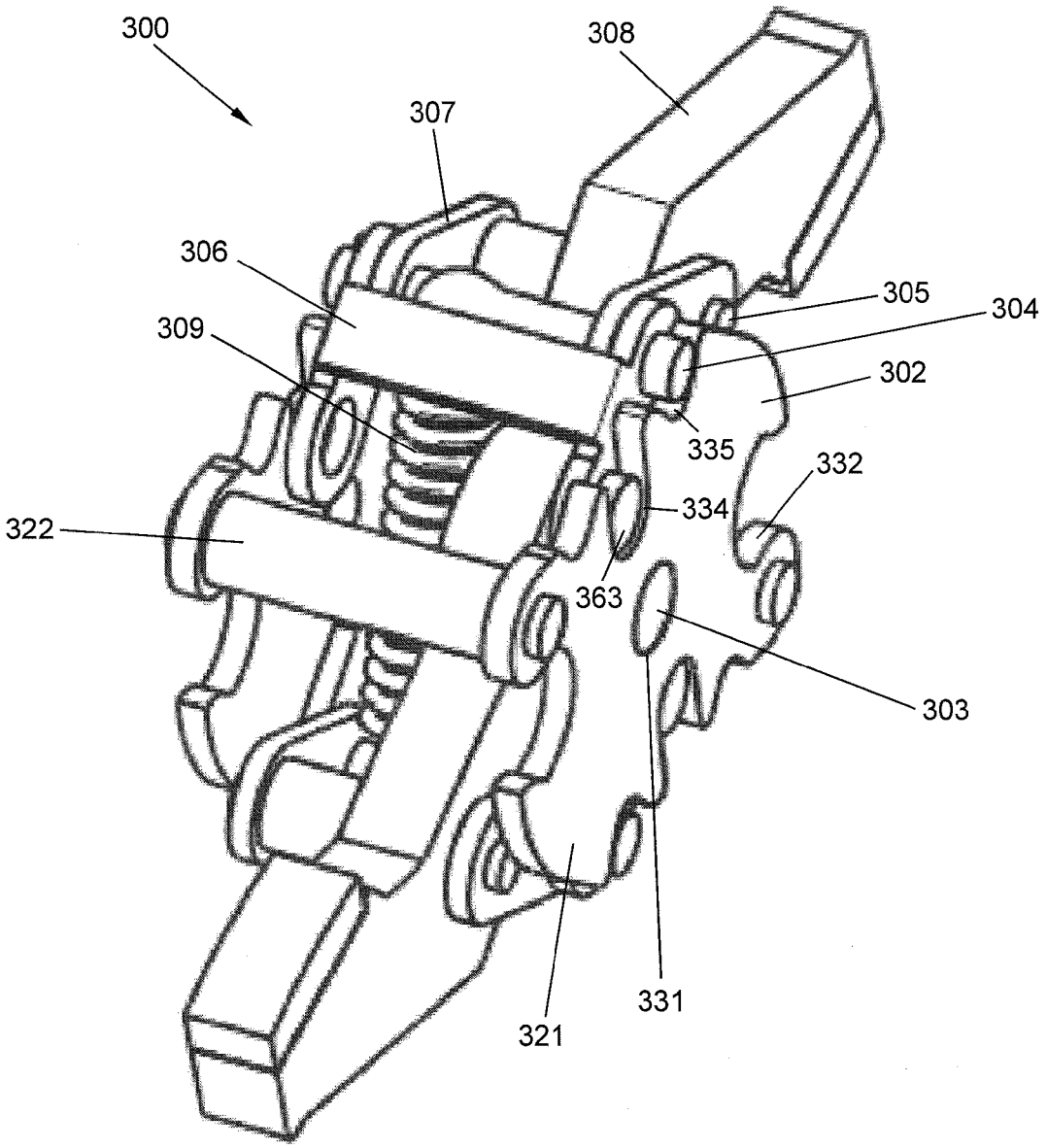
FIG. 7 illustrates the structure of a second rotor component in a contact module for circuit breaker according to an embodiment of the present invention.

The present invention provides two kinds of rotor components. FIG. 6 illustrates the structure of a first rotor component in a contact module for circuit breaker according to an embodiment of the present invention. FIG. 7 illustrates the structure of a second rotor component in a contact module for circuit breaker according to an embodiment of the present invention. A difference between the first rotor component and the second rotor component is the position of the contact spring. The second rotor component will be described hereafter as an example.

As shown in FIG. 7, the second rotor component 300 comprises: a rotor support 302, a first shaft 303, a second shaft 304, a third shaft 305, a first connection rod 306, a second connection rod 307, a contact bridge 308 and a contact spring 309. The contact bridge 308 is provided in the rotor support 302. The contact bridge 308 rotates relative to the rotor support 302 by means of the first shaft 303, the second shaft 304, the third shaft 305, the first connection rod 306 and the second connection rod 307. The contact bridge 308 rotates between an initial pressure position and a maximum repulsion position. The contact spring 309 is a single contact spring, which is mounted on one side of the contact bridge 308 and located in the rotor support 302. The contact spring 309 in the second rotor component 300 is mounted on the left side of the contact bridge 308 (the "left side" here means the left side according to FIG. 7).

The rotor support 302 comprises two side plates 321 and two lateral shafts 322 that connect the two side plates. The two side plates 321 are uniform in shape and size, the two side plates 321 have a gap therebetween which is sufficient for the contact bridge 308 to pass through. The two lateral shafts 322 are centrosymmetric. Each side plate is provided with a central hole 331 in the center, and each side plate is provided with a pair of centrosymmetric linkage holes 332 and a pair of centrosymmetric connection slots 334. The pair of linkage holes 332 are disposed on two ends of the major axis of the side plate respectively, and the pair of the connection slots 334 are disposed on two ends of the minor axis of the side plate respectively. The central holes 331 on the two side plates 321 are aligned, the linkage holes 332 on the two side plates 321 are aligned, and the connection slots 334 on the two side plates 321 are aligned, so that the shafts may pass through the holes or slots.

Figure 8:
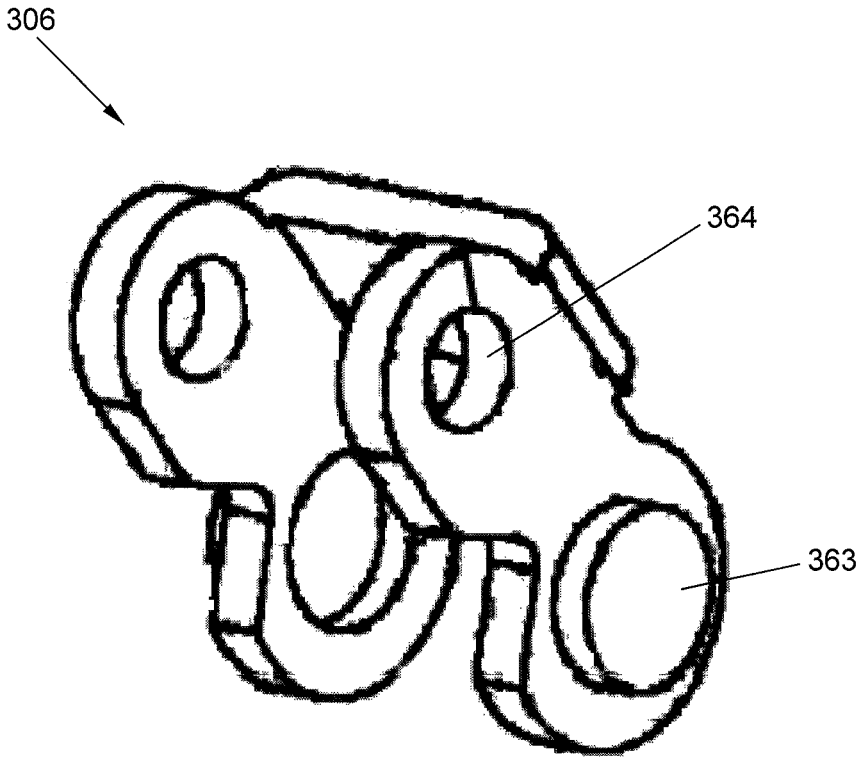
FIG. 8 illustrates the structure of a first connection rod in the second rotor component.

Two first connection rods 306 are mounted between the two side plates 321 and are arranged on different sides of the contact bridge 308. A first connection rod 306 is provided with a short shaft 363, which is mounted in the connection slot 334. The short shaft 363 is the rotation center of the first connection rod 306. FIG. 8 illustrates the structure of a first connection rod. The first connection rod 306 comprises a body and two terminal surfaces laterally extending from both ends of the body. Each terminal surface is provided with a convex short shaft 363 and a first shaft hole 364. The short shaft 363 and the first shaft hole 364 are symmetric about the body on the terminal surface. The short shaft 363 cooperates with the connection slot 334 by means of a minuteness gap. The rotor support 302 is provided with a connection rod slot and a spring slot on both side plates 321. A depth of the connection rod slot is not smaller than a thickness of the body of the first connection rod 306. The body enters into the connection rod slot when the first connection rod 306 rotates.

Figure 9:
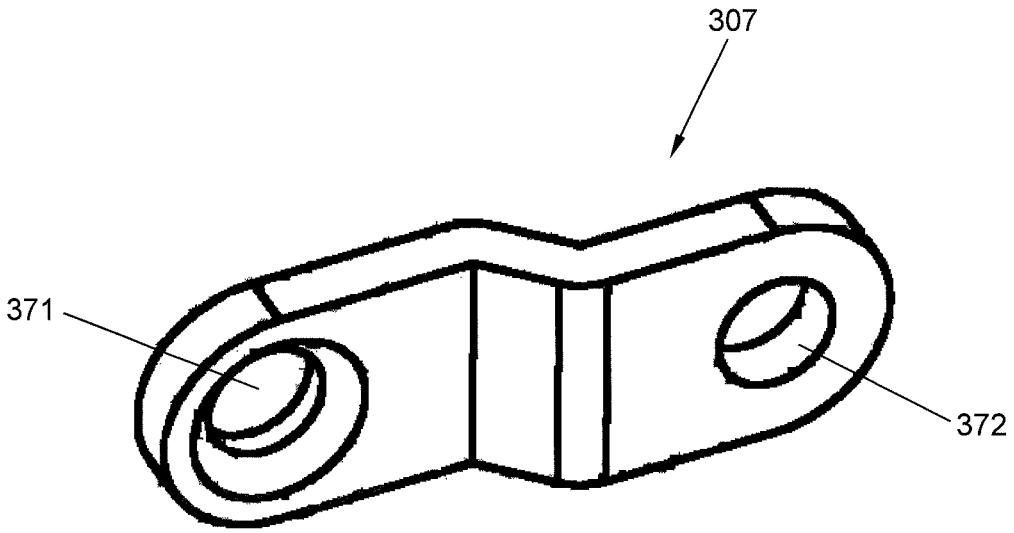
FIG. 9 illustrates the structure of a second connection rod in the second rotor component.

Two second connection rods 307 are mounted between the two side plates 321 and are arranged on different sides of the contact bridge 308. FIG. 9 illustrates the structure of a second connection rod. The second connection rod 307 comprises a body and two terminal surfaces laterally extending from both ends of the body. Each terminal surface is provided with a second shaft hole 371 and a third shaft hole 372. The second shaft hole 371 and the third shaft hole 372 are symmetric about the body on the terminal surface.

Figure 10:
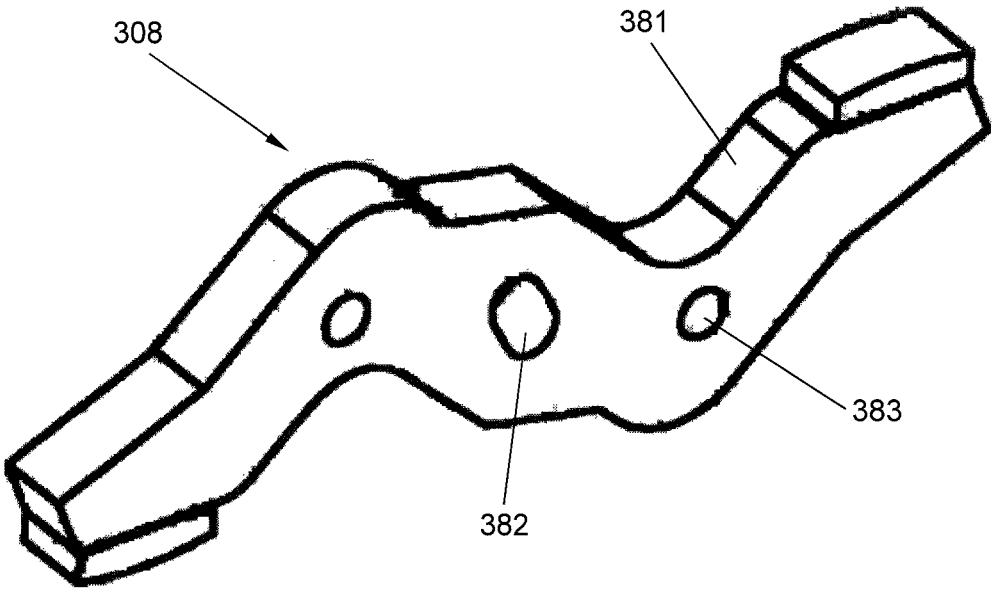
FIG. 10 illustrates the structure of a contact bridge in the second rotor component.

The contact bridge 308 is centrosymmetric in cross section. The contact bridge is provided with an obround hole 382 in the center, the first shaft 303 passes through the obround hole 382 and slides therein along a longitudinal direction of the obround hole. The first shaft 303 is the rotation center of the contact bridge 308 when the first shaft 303 slides to one end of the obround hole. The contact bridge is provided with a pair of centrosymmetric curved surfaces 381 and a pair of centrosymmetric through holes 383. Two curved surfaces 381 cooperate with two lateral shafts 322 to constrain the rotation range of the contact bridge 308. Two third shafts 305 pass through two through holes 383 respectively. The contact bridge 308 is provided with two contact points on each side, the two contact points are welded to a contact. The longitudinal direction of the obround hole 382 and a line connecting the two contact points form an included angle, which keeps balance of the contact pressure of the contact points on both sides of the contact bridge 308. FIG. 10 illustrates the structure of a contact bridge. A cylindrical surface on the lateral shaft 322 cooperates with the curved surface 381 on the contact bridge 308. Two lateral shafts 322 correspond to the initial pressure position and the maximum repulsion position of the contact bridge 308 respectively. The cylindrical surface on the lateral shaft 322 cooperates with the curved surface 381 by means of a minuteness gap.

The first shaft 303 passes through the obround hole 382 on the contact bridge 308 and the central hole 331 on the side plate 321. The first shaft 303 cooperates with the central hole 331 by means of a minuteness gap. Two second shafts 304 respectively pass through the first connection rod 306 and the second connection rod 307 and are mounted on profile of the two side plates 321. The two second shafts 304 are arranged centrosymmetrically. The side plate 321 is provided with a groove slot 335. The second shaft 304 passes through the first shaft hole 364 on the first connection rod 306 and the second shaft hole 371 on the second connection rod 307. The second shaft 304 is mounted on the groove slot 335. The second shaft 304 cooperates with the first shaft hole 364 and the second shaft hole 371 by means of minuteness gaps respectively.

Two third shafts 305 respectively pass through the through hole 383 on the contact bridge and the second connection rod 307. The two third shafts 305 are arranged centrosymmetrically. The third shaft 305 passes through the third shaft hole 372 on the second connection rod 307. The third shaft 305 cooperates with the third shaft hole 372 by means of a minuteness gap.

Two ends of the single contact spring 309 are mounted on two second shafts 304 respectively. The rotor support 302 is further provided with a spring slot on both side plates 321. The contact spring 309 is able to move in the spring slot. For the second rotor component 300, the single contact spring 309 is arranged in the spring slot on the left side plate 321 (the "left" means the "left side" according to FIG. 7).

FIG. 6 illustrates the first rotor component 400. A difference between the first rotor component 400 and the second rotor component 300 is the position of the contact spring. In the first rotor component 400, the contact spring is arranged on the right side (the "right side" means the "right" according to FIG. 6).

The present invention provides three kinds of rotation shafts. The three kinds of rotation shafts match with different contact housings respectively. A first rotation shaft 501 is a thick rotation shaft, which cooperates with the first contact housing 201 or the fourth contact housing 204. The first rotation shaft 501 cooperates with the first contact housing 201 or the fourth contact housing 204 via the strong side lug, which is step-shaped. The second rotation shaft 502 and the third rotation shaft 503 are thin rotation shafts. The second rotation shaft 502 or the third rotation shaft 503 cooperates with the second contact housing 202 or the third contact housing 203 via the weak side lug, which is inclined. A difference between the second rotation shaft 502 and the third rotation shaft 503 is the length. The second rotation shaft 502 is long so that the second rotation shaft 502 extends outside the contact housing. The third rotation shaft 503 is short and does not extend beyond the contact housing. All of the first rotation shaft 501, the second rotation shaft 502 and the third rotation shaft 503 can be connected to a linkage shaft so as to interconnect the single-pole switches.

Figure 3:
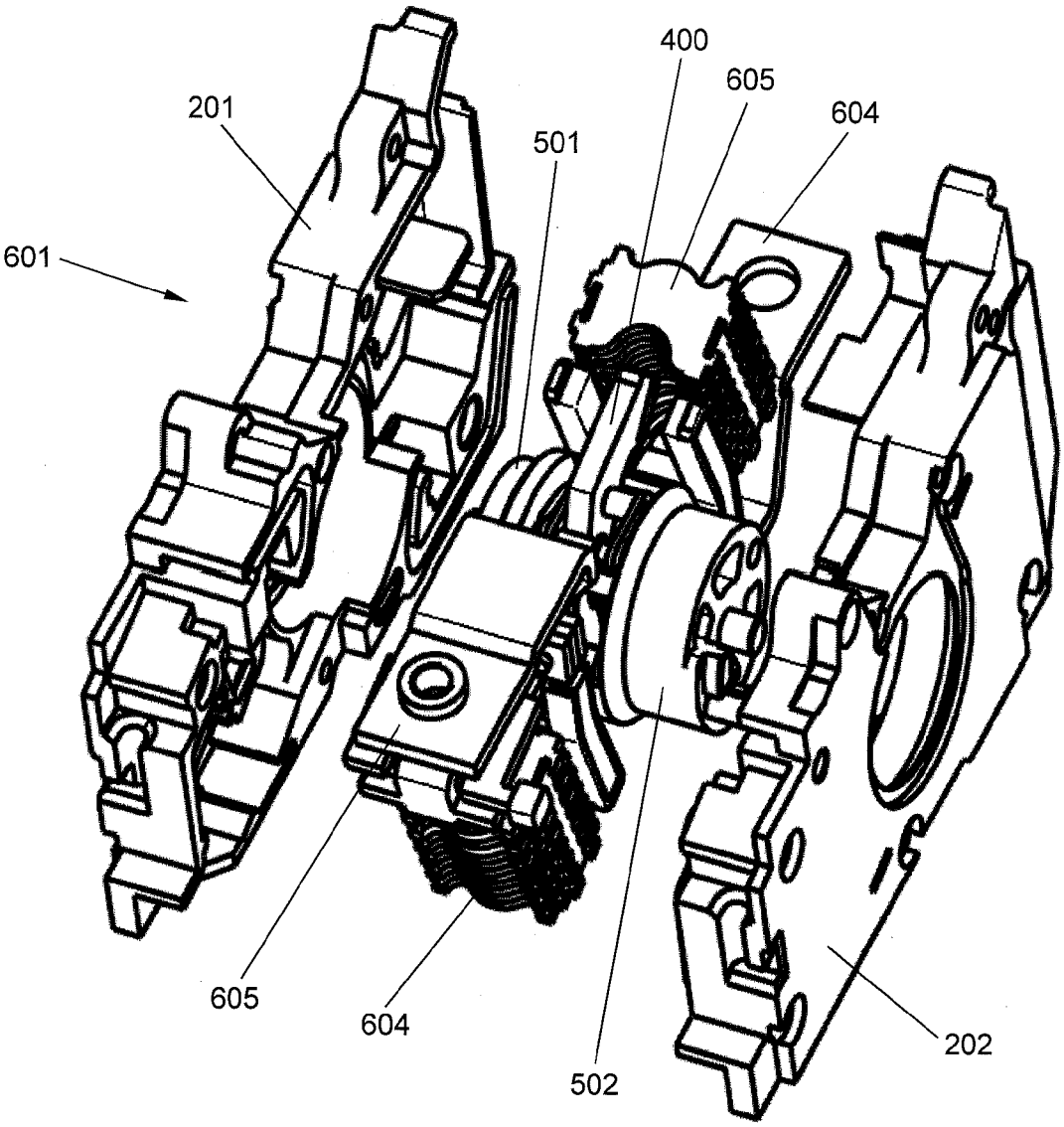
FIG. 3 illustrates the structure of a first single-pole switch in a contact module for circuit breaker according to an embodiment of the present invention.

The present invention provides three kinds of single-pole switches via combinations of the four kinds of contact housings, two kinds of rotor components and three kinds of rotation shafts. FIG. 3 illustrates the structure of a first single-pole switch in a contact module for circuit breaker according to an embodiment of the present invention. The first single-pole switch 601 comprises a first contact housing 201, a second contact housing 202, a first rotation shaft 501, a second rotation shaft 502, a first rotor component 400, a static contact 604 and an arc extinguishing chamber 605. The first contact housing 201 is a strong side contact housing and the second contact housing 202 is a weak side contact housing. The first contact housing 201 and the second contact housing 202 are assembled to form an internal chamber, which accommodates the first rotor component 400, the static contact 604 and the arc extinguishing chamber 605. The internal chamber deviates to the second contact housing 202, according to FIG. 11 and FIG. 12, the internal chamber deviates to the right side. A contact spring in the first rotor component 400 also locates on the right side. The first rotation shaft 501 is a thick rotation shaft and cooperates with the first contact housing 201. The second rotation shaft 502 is a thin shaft and cooperates with the second contact housing 202. The first rotation shaft 501 does not extend outside the first contact housing 201, while the second rotation shaft 502 extends outside the second contact housing 202.

Figure 4:
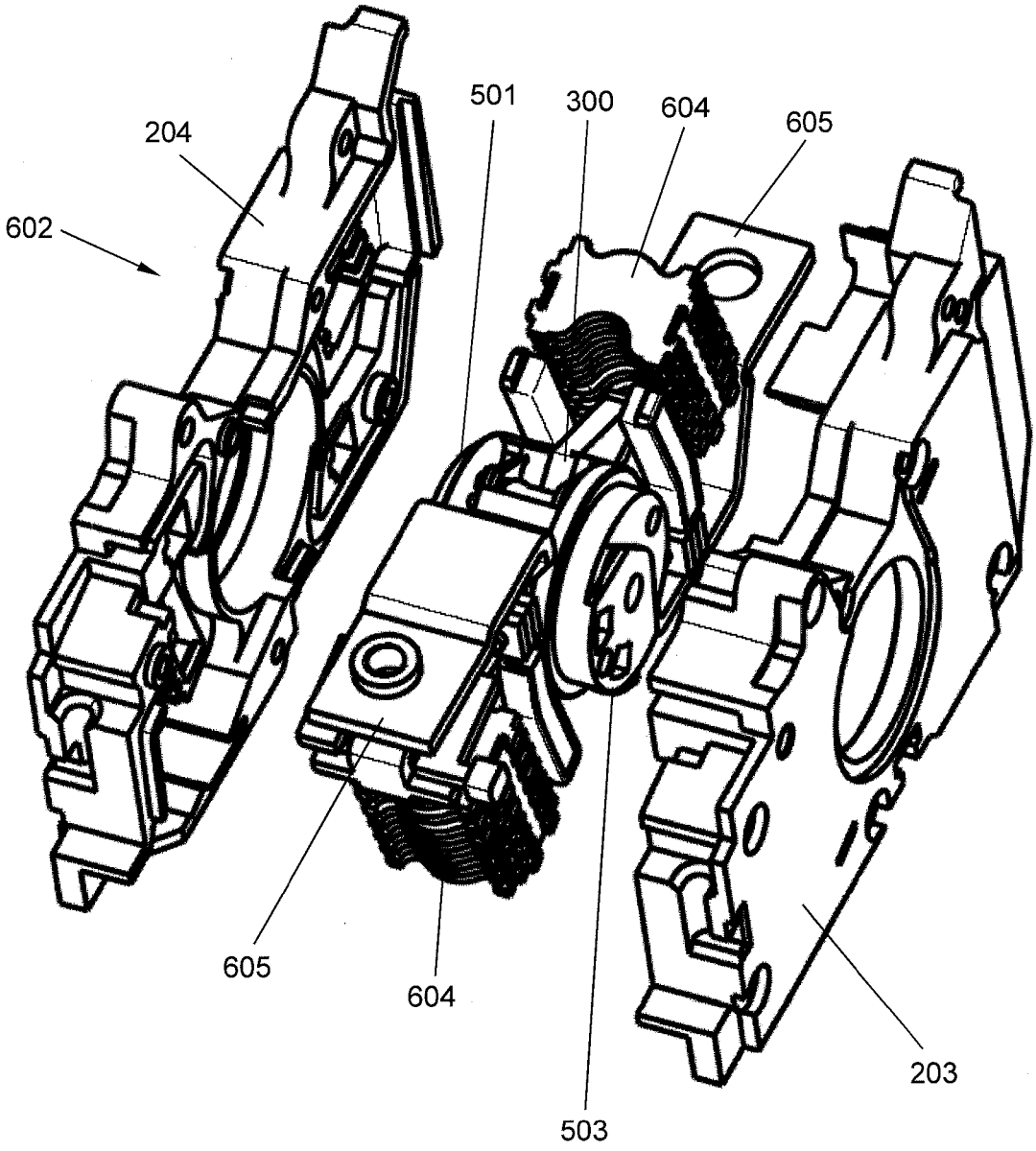
FIG. 4 illustrates the structure of a second single-pole switch in a contact module for circuit breaker according to an embodiment of the present invention.

FIG. 4 illustrates the structure of a second single-pole switch in a contact module for circuit breaker according to an embodiment of the present invention. The second single-pole switch 602 comprises a third contact housing 203, a fourth contact housing 204, a first rotation shaft 501, a third rotation shaft 503, a second rotor component 300, a static contact 604 and an arc extinguishing chamber 605. The third contact housing 203 is a weak side contact housing and has a symmetric structure with respect to the second contact housing 202. The fourth contact housing 204 is a strong side contact housing and has a symmetric structure with respect to the first contact housing 201. The third contact housing 203 and the fourth contact housing 204 are assembled to form an internal chamber, which accommodates the second rotor component 300, the static contact 604 and the arc extinguishing chamber 605. The second rotor component 300 has a symmetric structure with respect to the first rotor component, but the contact spring is located on different sides. The internal chamber deviates to the third contact housing 203, according to FIG. 11 and FIG. 12, the internal chamber deviates to the left side. A contact spring in the second rotor component 300 also locates on the left side. The first rotation shaft 501 cooperates with the fourth contact housing 204. The third rotation shaft 503 is a thin shaft and cooperates with the third contact housing 203. The third rotation shaft 503 does not extend outside the third contact housing 203, while the first rotation shaft 501 does not extend outside the fourth contact housing 204.

Figure 5:
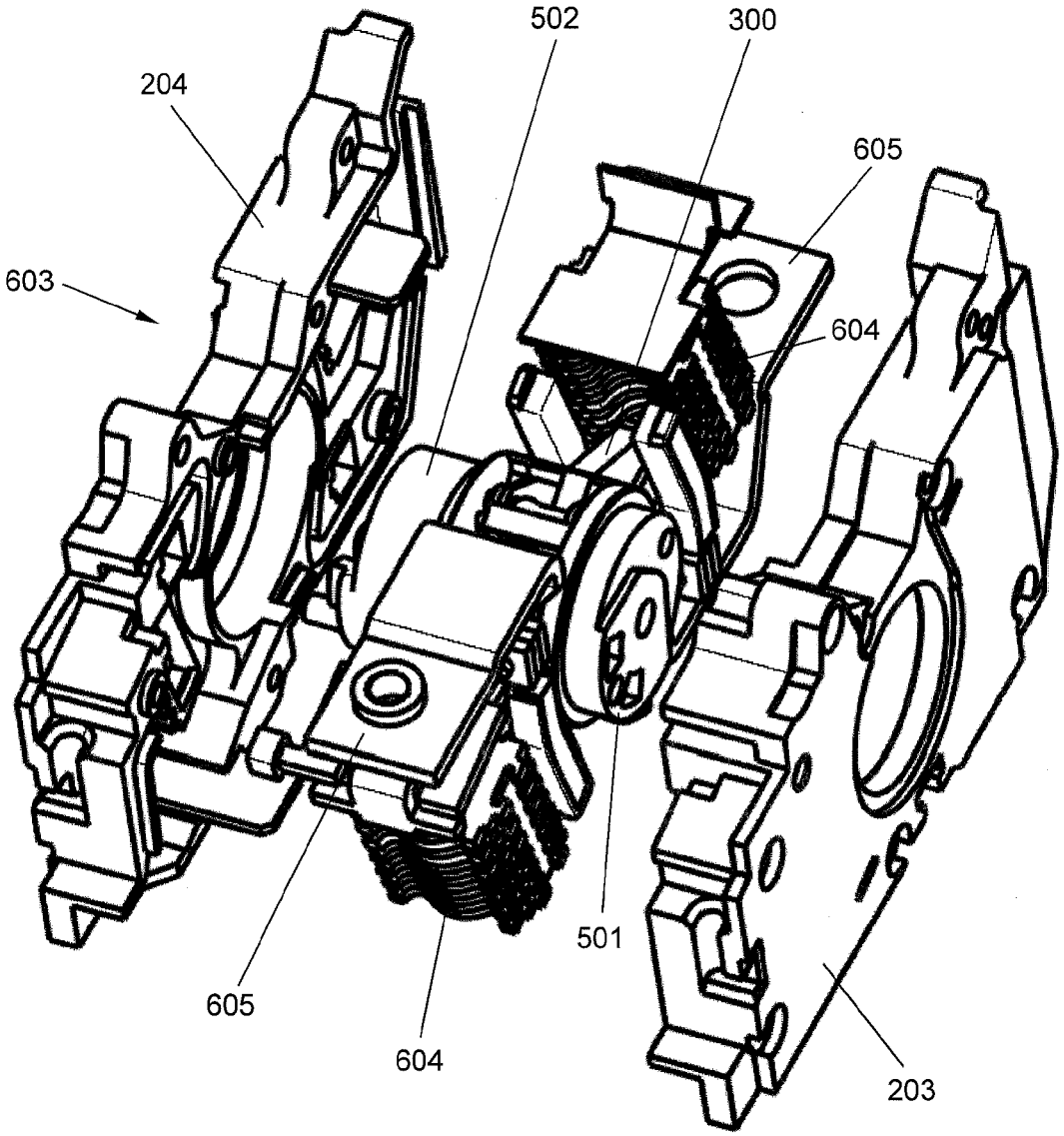
FIG. 5 illustrates the structure of a third single-pole switch in a contact module for circuit breaker according to an embodiment of the present invention.

FIG. 5 illustrates the structure of a third single-pole switch in a contact module for circuit breaker according to an embodiment of the present invention. The third single-pole switch 603 comprises a third contact housing 203, a fourth contact housing 204, a first rotation shaft 501, a second rotation shaft 502, a second rotor component 300, a static contact 604 and an arc extinguishing chamber 605. The third contact housing 203 is a weak side contact housing and has a symmetric structure with respect to the second contact housing 202. The fourth contact housing 204 is a strong side contact housing and has a symmetric structure with respect to the first contact housing 201. The third contact housing 203 and the fourth contact housing 204 are assembled to form an internal chamber, which accommodates the second rotor component 300, the static contact 604 and the arc extinguishing chamber 605. The second rotor component 300 has a symmetric structure with respect to the first rotor component, but the contact spring is located on different sides. The internal chamber deviates to the third contact housing 203, according to FIG. 11 and FIG. 12, the internal chamber deviates to the left side. A contact spring in the second rotor component 300 also locates on the left side. The first rotation shaft 501 cooperates with the fourth contact housing 204. The second rotation shaft 502 cooperates with the third contact housing 203. The first rotation shaft 501 does not extend outside the fourth contact housing 204, while the second rotation shaft 502 extends outside the third contact housing 203.

Figure 11:
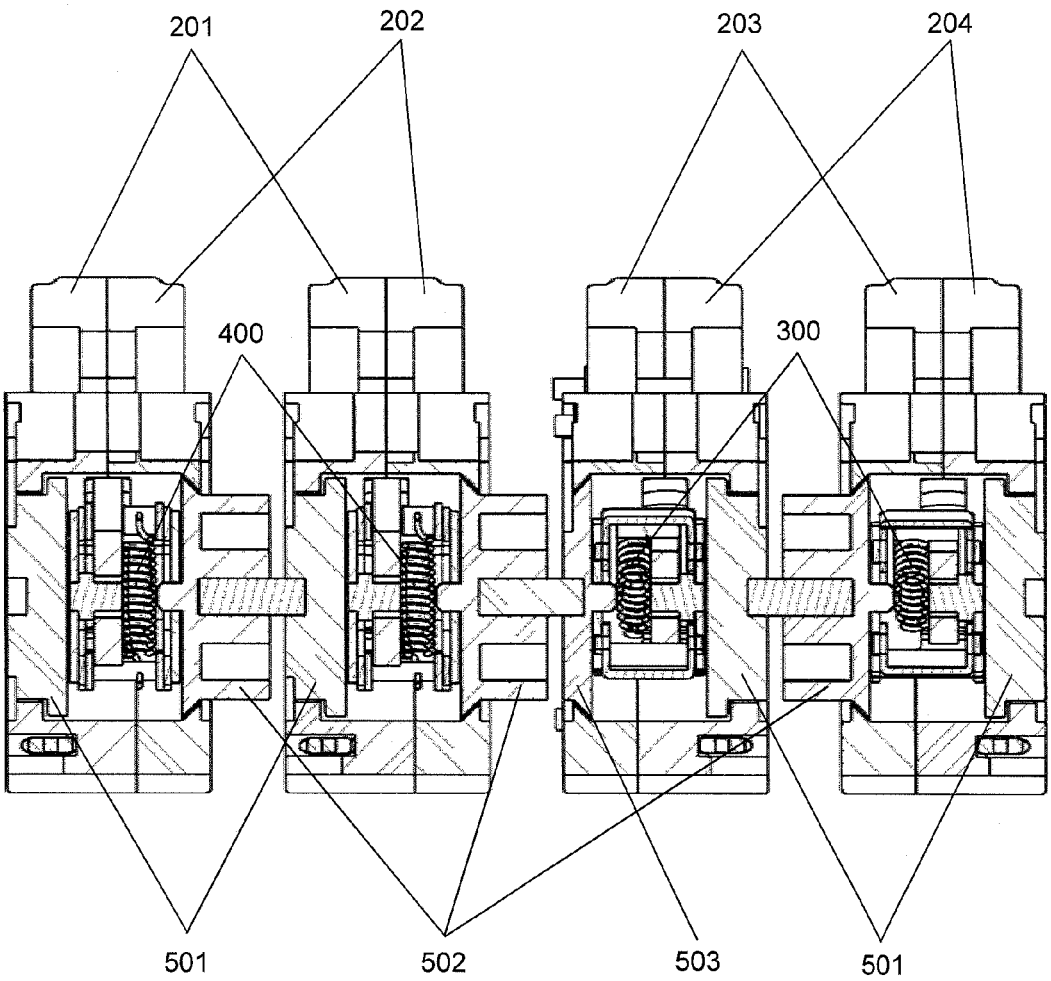
FIG. 11 illustrates a sectional view of a contact module for circuit breaker of the present invention while the single-pole switches are connected.
Figure 12:
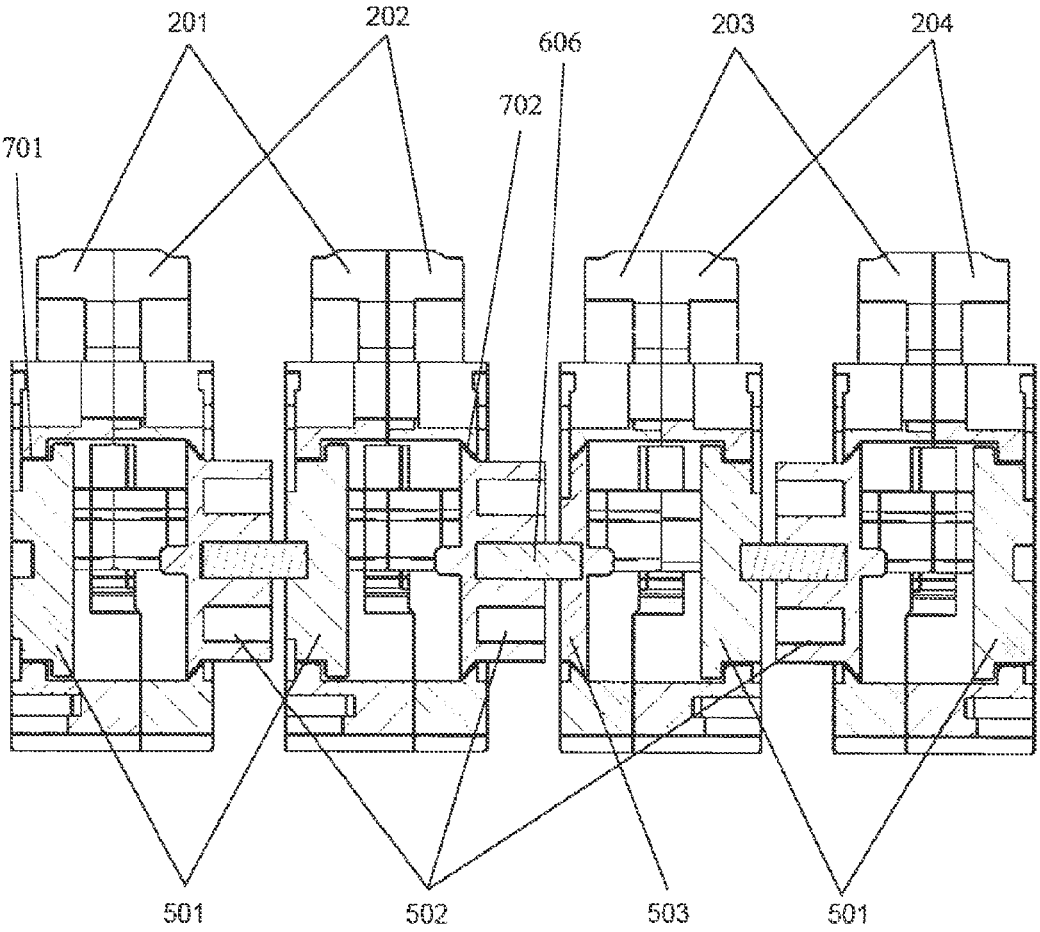
FIG. 12 illustrates a view modified based on FIG. 11, where the rotor components are removed and the contact module and the rotation shafts are reserved.

As shown in FIG. 2, FIG. 11 and FIG. 12, according to an embodiment, the contact module 100 for circuit breaker is provided with four single-pole switches, including two first single-pole switches 601, one second single-pole switch 602 and one third single-pole switch 603. FIG. 11 illustrates a sectional view of a contact module for circuit breaker of the present invention while the single-pole switches are connected. FIG. 12 illustrates a view modified based on FIG. 11, where the rotor components are removed and the contact module and the rotation shafts are reserved. As shown in FIG. 2, FIG. 11 and FIG. 12, from left to right, two first single-pole switches 601, one second single-pole switch 602 and one third single-pole switch 603 are arranged in sequence. Adjacent single-pole switches are connected via a linkage shaft 606. The linkage shaft 606 connects the first rotation shaft, the second rotation shaft or the third rotation shaft. As shown in FIG. 12, step-shaped strong side lugs 701 and inclined weak side lugs 702 are presented clearly. The two first single-pole switches 601 act as N phase and A phase of the contact module. The operation mechanism 103 is connected to the second single-pole switch 602. The second single-pole switch 602 acts as B phase of the contact module. The third single-pole switch 603 acts as C phase of the contact module.

According to the contact module for circuit breaker of to the present invention, an operation mechanism controls the close/open status of the circuit breaker. When the circuit breaker is closed, current flows through a static contact on one side, a rotor component, a static contact on the other side and a release mechanism in sequence. The release mechanism protects the circuit breaker by opening the circuit breaker when the system is overload for a longtime or abnormal current appears in the system.

Figure 13:
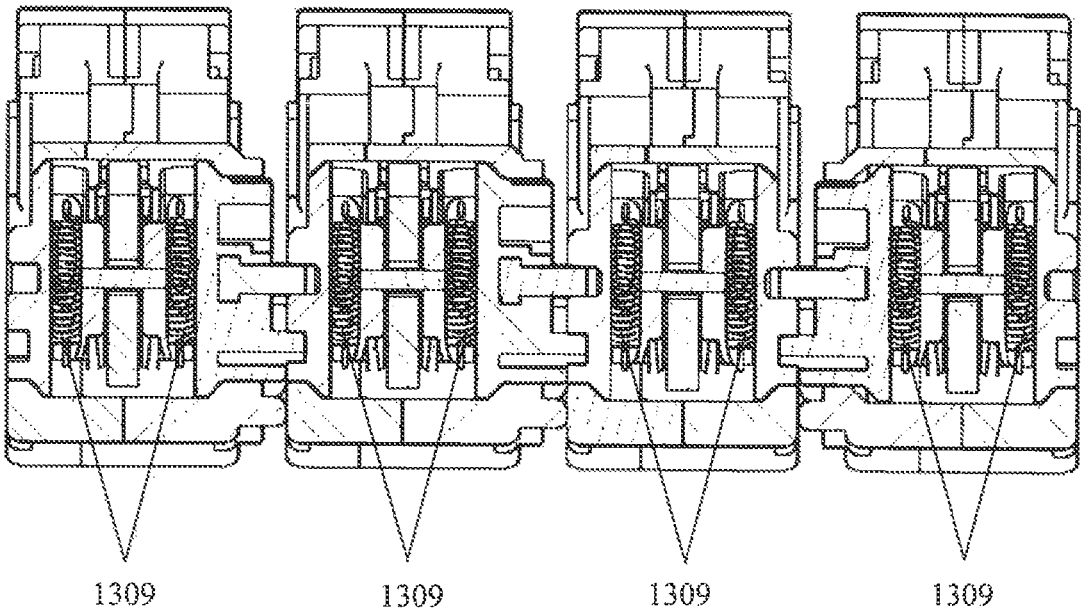
Prior art FIG 13
FIG. 13 illustrates a sectional view of a contact module for circuit breaker in prior art while the single-pole switches are connected.

The contact module for circuit breaker of the present invention uses asymmetric structure and a single contact spring, so that a width dimension of a multilevel circuit breaker formed by cascading of a plurality of single-pole switches will be reduced significantly. For example, a four-level circuit breaker according to the present invention has a width dimension of 100 mm and a spacing of 25 mm, a short circuit breaking capacity of the circuit breaker is 400V, 150 KA. According to prior art, when provided with a same short circuit breaking capacity, a four-level circuit breaker in prior art will have a width dimension of 120 mm and a spacing of 30 mm, which is 20% larger than that of the present invention. The reason is that symmetric structure and dual contact springs are used in prior art. FIG. 13 illustrates interconnected single-pole switches, in which symmetric structure and dual contact springs 1309 are utilized.

The present invention utilizes an asymmetric structure. For a single-pole switch, the thickness of side walls on one side of the housing is reduced and only a single contact spring is used in a rotor component. A dimension of a contact module is reduced while maintaining the strength of the contact module and a current breaking capacity of the circuit breaker.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A contact module for a circuit breaker comprising: a base, a cover, an operation mechanism, at least three single-pole switches and a release mechanism, wherein the cover is mounted on the base to form an accommodation space, in which the operation mechanism, the at least three single-pole switches and the release mechanism are disposed;

the operation mechanism is connected to one of the at least three single-pole switches, and the release mechanism is connected to the at least three single-pole switches;

all of the at least three single-pole switches are asymmetrical, each single-pole switch comprises a strong side and a weak side; for each single-pole switch, a contact housing on the strong side is thick and is connected to a thick shaft, while a contact housing on the weak side is thin and is connected to a thin shaft; a rotor component in each single-pole switch only has a single contact spring and the single contact spring is mounted on the weak side;

rotating shafts of adjacent single-pole switches are connected by a linkage shaft so that the single-pole switches are connected, and a strong side of one single-pole switch is connected to a weak side of another single-pole switch.

2. The contact module for circuit breaker according to claim 1, wherein each single-pole switch comprises a contact housing module assembled by two contact housings, a rotor component disposed in the contact housing module, and two rotation shafts connecting the rotor component and the two contact housings:

the assembled two contact housings form an internal chamber in which the rotor component is mounted, the contact housing on the strong side forms thick side walls of the internal chamber and the contact housing on the weak side forms thin side walls of the internal chamber;

the thick shaft cooperates with the thick side walls of the internal chamber formed by the contact housing on the strong side, and a strong side lug is provided;

the thin shaft cooperates with the thin side walls of the internal chamber formed by the contact housing on the weak side, and a weak side lug is provided.

3. The contact module for circuit breaker according to claim 2, wherein the strong side lug is step-shaped, the weak side lug is inclined.

4. The contact module for circuit breaker according to claim 2, wherein the at least three single-pole switches comprise a first single-pole switch, a second single-pole switch and a third single-pole switch;

two first single-pole switches act as N phase and A phase of the contact module, the operation mechanism is connected to the second single-pole switch, the second single-pole switch acts as B phase of the contact module, the third single-pole switch acts as C phase of the contact module.

5. The contact module for circuit breaker according to claim 4, wherein the first single-pole switch comprises a first contact housing, a second contact housing, a first rotation shaft, a second rotation shaft, a first rotor component, a static contact and an arc extinguishing chamber;

the first contact housing is a strong side contact housing and the second contact housing is a weak side contact housing, the first contact housing and the second contact housing are assembled to form an internal chamber, which accommodates the first rotor component, the static contact and the arc extinguishing chamber;

the first rotation shaft is a thick rotation shaft and cooperates with the first contact housing, the second rotation shaft is a thin shaft and cooperates with the second contact housing, the first rotation shaft does not extend outside the first contact housing, while the second rotation shaft extends outside the second contact housing.

6. The contact module for circuit breaker according to claim 5, wherein the second single-pole switch comprises a third contact housing, a fourth contact housing, a first rotation shaft, a third rotation shaft, a second rotor component, a static contact and an arc extinguishing chamber;

the third contact housing is a weak side contact housing and has a symmetric structure with respect to the second contact housing, the fourth contact housing is a strong side contact housing and has a symmetric structure with respect to the first contact housing, the third contact housing and the fourth contact housing are assembled to form an internal chamber, which accommodates the second rotor component, the static contact and the arc extinguishing chamber, the second rotor component has a symmetric structure with respect to the first rotor component;

the first rotation shaft cooperates with the fourth contact housing, the third rotation shaft is a thin shaft and cooperates with the third contact housing, the third rotation shaft does not extend outside the third contact housing, and the first rotation shaft does not extend outside the fourth contact housing.

7. The contact module for circuit breaker according to claim 6, wherein the third single-pole switch comprises a third contact housing, a fourth contact housing, a first rotation shaft, a second rotation shaft, a second rotor component, a static contact and an arc extinguishing chamber;

the third contact housing is a weak side contact housing and has a symmetric structure with respect to the second contact housing, the fourth contact housing is a strong side contact housing and has a symmetric structure with respect to the first contact housing, the third contact housing and the fourth contact housing are assembled to form an internal chamber, which accommodates the second rotor component, the static contact and the arc extinguishing chamber, the second rotor component has a symmetric structure with respect to the first rotor component;

the first rotation shaft cooperates with the fourth contact housing, the second rotation shaft cooperates with the third contact housing, the first rotation shaft does not extend outside the fourth contact housing, while the second rotation shaft extends outside the third contact housing.

* * * * *